US006065670A

United States Patent [19]

Mahon

[11] Patent Number: 6,065,670

[45] Date of Patent: May 23, 2000

[54] WHIP

[75] Inventor: James Mahon, Stratford-upon-Avon, United Kingdom

[73] Assignee: Aircush Limited, Warwickshire, United Kingdom

[21] Appl. No.: 09/161,219

[22] Filed: Sep. 28, 1998

[51] Int. Cl.[7] ..... B68B 11/00

[52] U.S. Cl. ..... 231/2.1

[58] Field of Search ..... 231/2.1, 3, 4; 463/47.2

[56] References Cited

U.S. PATENT DOCUMENTS

| | | | |
|---|---|---|---|
| 432,486 | 7/1890 | Gowdy | 231/2.1 |
| 511,816 | 1/1894 | Steimer et al. | 231/2.1 |
| 811,964 | 2/1906 | Simon | 231/2.1 |

FOREIGN PATENT DOCUMENTS

| | | | |
|---|---|---|---|
| 2220123 | 1/1990 | United Kingdom | 231/2.1 |
| 2 281 186 | 3/1995 | United Kingdom | 231/2.1 |

*Primary Examiner*—Robert P. Swiatek
*Attorney, Agent, or Firm*—Young & Thompson

[57] ABSTRACT

A humane whip for use in horse racing comprises an elongate self-supporting spine of glass fibre, carbon fibre or the like, surrounded by an outer flexible sleeve of rubber or soft plastics material. Shock-absorbing members are disposed between the inner spine and the surrounding sleeve, and may comprise internal ribs on the sleeve and the air trapped between the spine and sleeve. The soft flexible sleeve has a reinforcing layer which inhibits stretching of the sleeve at least in the longitudinal direction. The tips of both the inner spine and the outer sleeve are each formed with an enlarged bulb.

23 Claims, 2 Drawing Sheets

WHIP

BACKGROUND OF THE INVENTION

The invention relates to a novel form of whip suitable for use in horse racing.

Occasionally public concern arises over what is considered to be excessive use of the whip in horse racing. It is generally acknowledged, particularly by riders and others having experience of horses, that in racing it is essential to provide the rider with a whip for controlling the horse. For example, a horse being ridden in a race may have a tendency suddenly to veer to one side or the other and this can be dangerous, particularly in jumping races, due to the risk of interference or collision with other horses. The rider therefore requires a whip to provide instant control of the direction of the horse.

However controversy sometimes arises regarding the use of the whip on the hindquarters of the horse for the purpose of encouraging the horse to greater effort in order to win the race.

Whips for horse racing, have hitherto been made from a variety of materials. For example, whips have been formed from tapered lengths of cane, whale bone or similar hard but flexible materials. In more recent times, however, whips have been formed from glass fibre, either being formed entirely from glass fibre or comprising a thin flexible steel rod sheathed in glass fibre. In spite of the flexibility of such whips, the outer surface of the glass fibre is hard and this, combined with the comparative rigidity of the material, means that application of the whip to a horse's hindquarters can be extremely painful for the horse and can result in physical damage, and breaking of the skin of the horse to draw blood, upon repeated application.

In an endeavour to reduce the pain and physical damage caused by such whips, it has become the practice for glass fibre whips to be covered with a felt wrap having, at the end, flaps which extend beyond the extremity of the glass fibre. While this has alleviated part of the problem by slightly softening the impact of the whip, and spreading it over a larger area, the hardness of the glass fibre can still be felt through the wrap and unacceptable pain and damage may still be caused to the horse through persistent use of the whip by the rider, especially where the wrap has become wet from sweat or rain. Furthermore, the felt flaps at the end of the whip can themselves cause excessive pain and damage, again particularly when they become wet from the horse's sweat or from rain.

British Patent No. 2281186 describes a more humane type of whip intended to fulfill the purpose for which a whip is necessary when racing, but which will not cause excessive and unacceptable pain and damage to the horse even though it might be applied to the animal's hindquarters with great force and persistence by the rider. The whip described in British Patent No. 2281186 comprises an elongate self-supporting spine of glass fibre surrounded by an outer flexible sleeve of rubber or soft plastics material. Shock-absorbing means are disposed between the inner spine and the surrounding sleeve, and may comprise air or other gas trapped between the spine and sleeve, a foamed latex filler, resiliently flexible spacers between the sleeve and spine, or flexible tubing wound helically around and along the spine, With this construction, as the comparatively soft surface of the outer sleeve strikes the horse's body its movement is arrested and the following inner spine is slowed down and cushioned in its subsequent impact by the shock-absorbing means. The effect is therefore of always providing a cushioning and protecting layer between the horse's body and the hard inner spine of the whip. It is found in practice that such a whip, even when struck with greater force than a conventional whip, will cause less pain and less damage to the body being struck due to the in-built cushioning effect.

The present invention provides improvements to the basic type of humane whip described in British Patent No. 2281186.

SUMMARY OF THE INVENTION

According to the invention there is provided a whip comprising an elongate self-supporting resiliently flexible inner spine, an outer flexible sleeve surrounding the inner spine and spaced therefrom and shock-absorbing means disposed between the inner spine and the surrounding sleeve along at least part of the length thereof, the outer flexible sleeve including an outer layer formed from a flexible material to which is bonded a reinforcing material which inhibits stretching of the outer layer at least in the longitudinal direction thereof.

The reinforcing material may comprise a mesh material which is less extensible than the material of the outer layer, at least in the longitudinal direction thereof.

The reinforcing material may be generally tubular in configuration, extending coaxially with the outer layer for at least part of the length thereof.

Alternatively the reinforcing material may be in the form at least one elongate strip extending generally longitudinally of the outer layer. For example, the elongate strip of reinforcing material may extend generally helically around the inner surface of the outer layer.

The outer flexible sleeve may also include an inner layer which is bonded to the reinforcing layer and outer layer so that the reinforcing layer is sandwiched between the inner and outer layers. In this case the inner and outer layers may be integral with one another so that the reinforcing layer is embedded therein.

The shock-absorbing means may comprise a fluid enclosed between the sleeve and spine. The fluid preferably comprises air or other gas. In this case the outer sleeve is preferably sealed in substantially air-tight manner around the inner spine. The shock-absorbing means may also comprise a plurality of ribs formed on the inner surface of the outer flexible sleeve and extending generally helically along at least a part of the outer sleeve.

The invention also provides a whip comprising an elongate self-supporting resiliently flexible inner spine, an outer flexible sleeve surrounding the inner spine and spaced therefrom, and shock-absorbing means disposed between the inner spine and the surrounding sleeve along at least part of the length thereof, the shock-absorbing means including a plurality of ribs formed on the inner surface of the outer flexible sleeve and extending generally helically along at least a part of the outer sleeve, the inner extremities of the ribs being spaced from, and our of contact with, the inner spine when the spine is coaxial with the outer sleeve.

In a preferred embodiment there are provided three ribs extending generally helically along at least a part of the outer sleeve, said ribs being spaced substantially equally apart circumferentially of the sleeve.

The invention further provides a whip comprising an elongate self-supporting resiliently flexible inner spine, an outer flexible sleeve surrounding the inner spine and spaced therefrom, and shock-absorbing means disposed between the inner spine and the surrounding sleeve along at least part of the length thereof, the whip including a handle portion at one end thereof and a tip portion at the opposite end thereof, the tip portion of the flexible sleeve being in the form of a smoothly rounded bulb which is of greater cross-dimension than the portion of the sleeve immediately adjacent the bulb. The smoothly rounded bulb may be generally part-spherical.

The invention farther provides a whip comprising an elongate self-supporting resiliently flexible inner spine, an outer flexible sleeve surrounding the inner spine and spaced therefrom and shock-absorbing means disposed between the inner spine and the surrounding sleeve along at least part of the length thereof a tip portion of the inner spine being spaced from a surrounding tip portion of the flexible sleeve, and the tip portion of the spine being in the form of a smoothly rounded bulb which is of greater cross-dimension than the portion of the spine immediately adjacent the bulb. The smoothly rounded bulb on the spine may be generally part-spherical.

The bulb may be separately formed from the inner spine and attached thereto. In this case the bulb may be formed on one end of a tubular sleeve which is fitted over the end of the inner spine. The bulb on the inner spine may be hollow and may be formed from a resiliently flexible material.

DETAILED DESCRIPTION OF THE PREFERRED EMBODIMENTS

Figure 1:
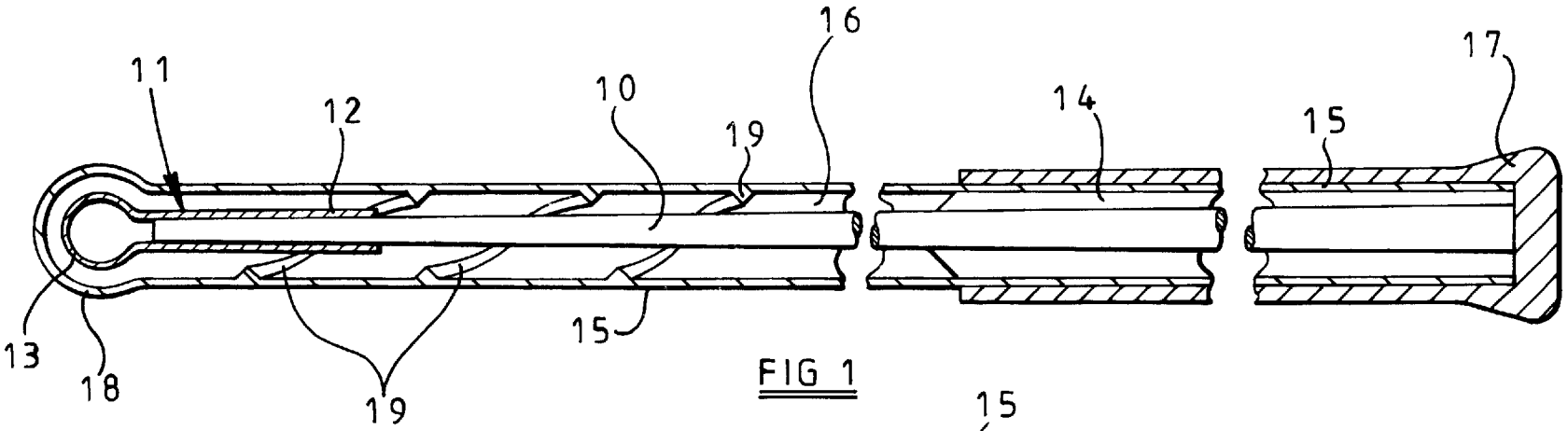
FIG. 1 is a diagrammatic longitudinal section through a whip in accordance with the present invention.

Referring to FIG. 1: the whip comprises a central elongate tapered spine 10 of circular cross-section which is formed from glass fibre, carbon fibre or graphite composition material or any other semi-rigid material having a suitable degree of resilient flexibility. The spine 10 is preferably solid throughout although the invention does not exclude arrangements where the spine is hollow, this depending on the nature and strength of the material from which it is formed.

At one end the spine 10 is provided with a tip portion 11 formed of flexible plastics material, such as polythene. The tip 11 comprises a tubular portion 12 which is fitted over the extremity of the spine 10 and glued to it, and an enlarged part-spherical bulb portion 13 which extends beyond the extremity of the spine and is of greater diameter than the end of the spine.

Adjacent the opposite thicker handle end of the spine it is encircled by a tubular sleeve 14. The material of the sleeve 14 may be natural or synthetic rubber, or a suitable plastics. Preferably the sleeve 14 has some flexibility and resilience so as to absorb some of the force with which a user might apply the whip.

The sleeve 14 and spine 10 are surrounded by an outer sleeve 15 which is comparatively soft and flexible when compared with the inner spine 10. The outer sleeve 15 may be of substantially constant diameter or may taper slightly in the same direction as the taper in the inner spine 10. The construction of the outer sleeve 15 will be described in more detail below with reference to FIGS. 2–4.

The outer sleeve 15 is so dimensioned that it fits snugly over the external surface of the sleeve 14 but is spaced from the rest of the inner spine 10 so as to provide an annular gap 16 between the spine and the inner surface of the sleeve 15.

At the handle end of the of the whip the outer sleeve 15 is covered by a handgrip 17 which is coextensive with the sleeve 14 and provides the outer surface of the handle of the whip where it is grasped by the user. The handgrip 17 may be formed from rubber or any other suitable material and may be ribbed so that it may be gripped more securely.

The outer sleeve 15 is closed at the opposite tip portion of the whip and is integrally formed with an enlarged part-spherical bulb 18 which is of greater diameter than the immediately adjacent part of the sleeve 15 and encloses, but is spaced from, the enlarged bulb 13 attached to the inner spine 10.

The inner surface of the outer sleeve 15 is integrally formed with a number of parallel ribs 19 which extend helically along the inner surface of the sleeve 15. In the present case there are provided three such ribs. The ribs are generally triangular in cross-section and the inner extremities of the ribs are spaced from the inner spine 10 when the spine is coaxial with the sleeve 15, as shown in FIG. 1. The ribs constitute shock-absorbing means between the inner spine 10 and the outer sleeve 15.

In the arrangement shown in FIG. 1, the helical ribs 19 extend along the sleeve 15 from a position adjacent the tip of the whip to a position approximately half-way between the tip of the whip and the nearer end of the handgrip 17. However, the ribs 19 may also extend for a greater distance along the sleeve 15, and a greater or lesser number of ribs may be employed. The ribs may also be of different cross-section; for example they may be of rectangular or curved cross-section.

The various components of the whip may be bonded together by suitable adhesives or by any other bonding process such as heat welding.

The sleeve 15 may be hermetically sealed around the spine 10 so that air in the annular space 16 between the spine and the outer sleeve is trapped and also acts as shock-absorbing means.

When the whip is used on the hindquarters of the horse it is the comparatively soft outer sleeve 15 which first contacts the skin of the horse, and the stiffer inner spine 10 subsequently impacts on the inner surface of the outer sleeve 15. However, the ribs 19, together with the air trapped within the sleeve around the spine 10, serve to cushion the impact of the spine on the inner surface of the sleeve and thus reduce the force of the impact. At the same time the comparatively soft material of the sleeve 15 spreads the force of the impact over a greater area. The effect of this is to reduce the force per unit area transmitted to the body of the horse, thus reducing the pain inflicted on the animal by the blow and also reducing the risk of damage to the horse's skin and flesh.

By providing shock-absorbing ribs 19 which are spaced from the inner spine 10, instead of being in contact with it, there is achieved an optimum combination of effectiveness of the whip, and "feel" for the rider, with reduction of pain and damage to the horse, By spacing the inner spine 10 from the ribs 19 the spine can continue to move rapidly relative to the outer sleeve 15 when the sleeve first contacts the body of the horse, since movement of the inner spine is restricted only by the cushion of air surrounding it. However, when the spine 10 subsequently contacts the surrounding ribs 19 these tend to slow down the final part of the movement of the spine 10 as it impacts on the sleeve 15. The ribs dissipate the impact throughout the sleeve 15 which in turn spreads the impact over a larger area of the horse's body.

The enlarged bulb 18 on the end of the outer sleeve 15 also serves to reduce the pain of impact of the tip of the whip on the horse. Generally speaking the tip portion of the whip will be moving at the greatest speed when it contacts the horse so that, if the whip has a conventional narrow tip, the pain can still be excessive. The enlarged bulb 18 serves to spread the force exerted by the tip of the whip over a greater area and thus reduces the impact and pain. The enlarged bulb 13 on the end of the inner spine 10 enhances this effect and also prevents the tip of the spine 10 breaking through the outer sleeve 15.

Figure 2:
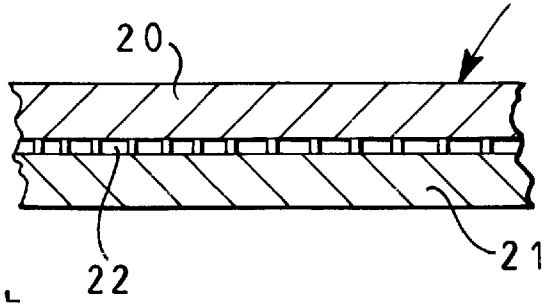
FIG. 2 is an enlarged cross-sectional view through a portion of the outer sleeve of the whip.
Figure 4:
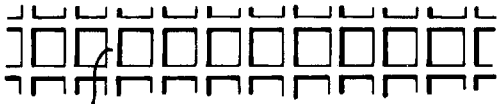
FIG. 4 is a similar view of an alternative form of reinforcing mesh.
Figure 3:
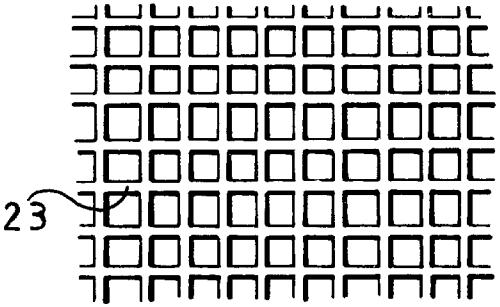
FIG. 3 is an enlarged view of one type of reinforcing mesh which may be used in the outer sleeve.

Since the outer sleeve 15 is formed from relatively soft material there may be a tendency, in prior art constructions, for the material to stretch with use. FIGS. 2–4 show a preferred construction of the outer sleeve 15, in accordance with the invention, to overcome this problem.

Referring to FIG. 2, the outer sleeve 15 of the whip comprises an outer layer 20 of rubber or other comparatively soft and flexible material, such as a suitable plastics, an inner layer 21 which may be of similar or different material to the outer layer, and a reinforcing layer 22 sandwiched between the two layers 20, 21.

The reinforcing layer 22 may be of any material which provides resistance to stretching of the sleeve 15 at least in the longitudinal direction i.e. is less elastic than the soft and flexible material of the sleeve. For example, the reinforcing layer 22 may be a moulded nylon mesh 23 as shown in FIG. 3. The mesh may be in the form of a tubular sleeve which extends along all or part of the outer sleeve 15, between the two layers 20, 21.

However, the outer sleeve 15 may conveniently be formed by a moulding process and in this case some circumferential elasticity of the sleeve is desirable to enable the sleeve to be removed from the mould. In this case, the reinforcing layer 22 may be in the form of narrow elongate strips of nylon mesh 24, as shown in FIG. 4, extending longitudinally of the sleeve 15 but spaced apart in the circumferential direction. The mesh strips may extend generally helically along the sleeve.

The sleeve 15 may conveniently be manufactured by sandwiching the reinforcing layer 22 between two separate layers 20, 21. In this case the layers 20, 21 may be bonded to each other between the interstices in the layer 22 so that the mesh layer becomes effectively embedded. Alternatively, the reinforcing layer 22 may be embedded in a single body of material, while it is molten during manufacture, so that the two layers 20, 21 in fact comprise two regions of a single integral body of material Other reinforcing means may be provided in the outer sleeve such as wires, tapes or sheet materials of any suitable composition.

Although the shock-absorbing arrangement shown in FIG. 1 is preferred, aspects of the prevent invention are also applicable to whips where the shock-absorbing means between the inner spine and the outer sleeve is of a different type, for example of any of the kinds described in the above-mentioned British Patent No. 2281186.

For example, the ribs 19 could be omitted so that the trapped air or other fluid between the spine 10 and sleeve 15 serves as the sole shock-absorbing means between the spine and sleeve. Other alternative shock-absorbing means are shown in FIGS. 4–7.

Figure 5:
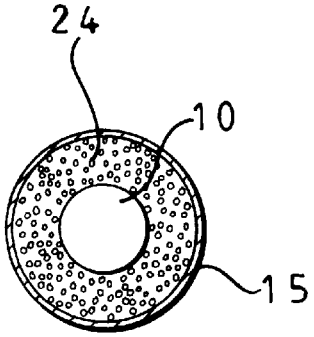
FIG. 5 is a cross-section through another form of whip, showing an alternative shock-absorbing arrangement.

Preferably, however, some form of mechanical shock-absorbing means is provided between the spine 10 and the sleeve 15. One such means is shown in FIG. 5 where the inner spine 10 is surrounded by a tapered sheath 24 of latex foam or other resiliently flexible material having a cellular structure. In this case the foam 24 serves as a cushion between the spine 10 and outer sleeve 15 so as to reduce the force per unit area transmitted to the horse's body by the inner spine 10.

Figure 6:
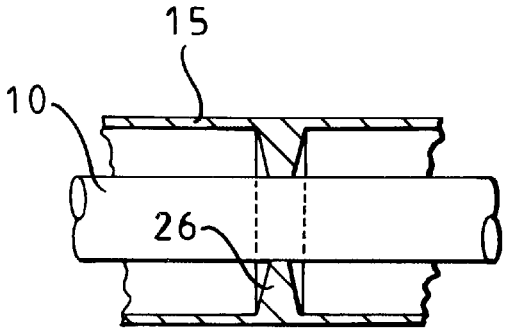
FIG. 6 is a partial longitudinal section through a further whip showing an alternative shock-absorbing arrangement.

In the modified arrangement shown in FIG. 6 the inner surface of the sleeve 15 is formed with a number of annular inward projections 26 spaced apart at intervals along the length of the sleeve 15. Only one of the projections 26 is shown in FIG. 6. As viewed in cross-section each annular projection tapers inwardly as it extends inwardly from the sleeve 15 towards the spine 10. The inner periphery of each annulus 26 engages the outer surface of the spine 10 so that the annulus, again, serves as a shock-absorber.

In the arrangement shown, each annulus 26 is integrally formed with the sleeve 15 and is thus formed from the same material. If required, however, each annulus 26 may be separately formed from the sleeve 15 and bonded to it, in which case each annulus may be formed from some other resiliently flexible material, such as a suitable flexible plastics, which differs from the material of the sleeve itself.

Figure 7:
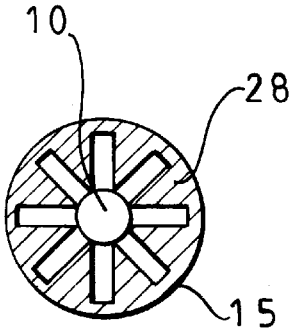
FIGS. 7 and 8 are similar views to FIGS. 5 and 6 respectively, showing further shock-absorbing arrangements.

FIG. 7 is a cross-section through a further form of whip in which the inner surface of the outer sleeve 15 is integrally formed with a plurality of ridges 28 of generally triangular cross-section, the ridges extending along the length of the sleeve 15, The inner edges of the triangular ridges 28 engage the outer surface of the inner spine 10 so that they act as shock-absorbers between the spine 10 and sleeve 15. As in the previously described arrangement the ridges 28 may be separately formed from the sleeve 15 and bonded to it, instead of being integrally formed with the sleeve as shown.

Figure 8:
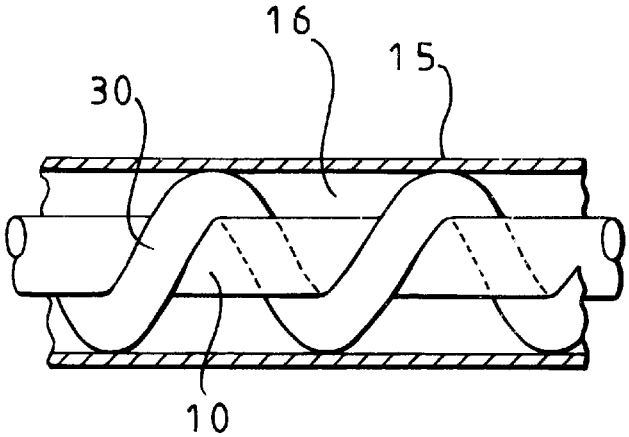

In the arrangement of FIG. 8 the shock-absorbing means comprises a length of polythene tubing 30 wrapped helically around the spine 10 and extending along the length thereof. The diameter of the polythene tubing 30 is preferably equal to the width of the annular space 18 between the spine 10 and sleeve 15 so that the tubing contacts the inner surface of the sleeve. The polythene tubing 30 has a natural resistance to compression across its diameter and it therefore serves as a shock-absorber between the spine 10 and outer sleeve 15. The ends of the tubing 30 may be sealed so as to enhance its resistance to compression.

In any of the arrangements described above the sleeve 15 is also preferably hermetically sealed so that the shock-absorbing effect is enhanced, in use, by the compression of air within the sleeve 15.

The shock-absorbing arrangements of FIG. 5 to 8 may be used in any form of whip according to the present invention.

The components of the whip may be of any required dimensions. The drawings are purely diagrammatic and not to scale. The materials employed for the components of the whip may also be of any suitable kind and the invention is not restricted to the particular materials described by way of example.

What is claimed is:

1. A whip comprising an elongate self-supporting resiliently flexible inner spine, an outer flexible sleeve surrounding the inner spine and spaced therefrom, and shock-absorbing means disposed between the inner spine and the surrounding sleeve along at least part of the length thereof, the shock-absorbing means including a plurality of ribs formed on the inner surface of the outer flexible sleeve and extending generally helically along at least a part of the outer sleeve, the inner extremities of the ribs being spaced from, and out of contact with, the inner spine when the spine is coaxial with the outer sleeve.

2. A whip according to claim 1, wherein there are provided three ribs extending generally helically along at least a part of the outer sleeve, said ribs being spaced substantially equally apart circumferentially of the sleeve.

3. A whip comprising an elongate self-supporting resiliently flexible inner spine, an outer flexible sleeve surrounding the inner spine and spaced therefrom, and shock-absorbing means disposed between the inner spine and the surrounding sleeve along at least part of the length thereof, a tip portion of the inner spine being spaced from a surrounding tip portion of the flexible sleeve, and the tip portion of the spine being in the form of a smoothly rounded bulb which is of greater cross-dimension than the portion of the spine immediately adjacent the bulb.

4. A whip according to claim 3, wherein the smoothly rounded bulb on the spine is generally part-spherical.

5. A whip according to claim 3, wherein the bulb is separately formed from the inner spine and attached thereto.

6. A whip according to claim 5, wherein the bulb is formed on one end of a tubular sleeve which is fitted over the end of the inner spine.

7. A whip according to claim 3, wherein the bulb on the inner spine is hollow and formed from a resiliently flexible material.

8. A whip comprising an elongate self-supporting resiliently flexible inner spine, an outer flexible sleeve surrounding the inner spine and spaced therefrom and shock-absorbing means disposed between the inner spine and the surrounding sleeve along at least part of the length thereof, the outer flexible sleeve including an outer layer formed from a flexible material to which is bonded a reinforcing material which inhibits stretching of the outer layer at least in the longitudinal direction thereof, the reinforcing material being in the form of at least one elongate strip of reinforcing material which extends generally longitudinally of, and helically around, the inner surface of the outer layer.

9. A whip comprising an elongate self-supporting resiliently flexible inner spine, an outer flexible sleeve surrounding the inner spine and spaced therefrom and shock-absorbing means disposed between the inner spine and the surrounding sleeve along at least part of the length thereof, the outer flexible sleeve including an outer layer formed from a flexible material to which is bonded a reinforcing material which inhibits stretching of the outer layer at least in the longitudinal direction thereof, the outer flexible sleeve also including an inner layer which is bonded to the reinforcing layer and outer layer so that the reinforcing layer is sandwiched between the inner and outer layers.

10. A whip according to claim 9, wherein the inner and outer layers are integral with one another so that the reinforcing layer is embedded therein.

11. A whip according to claim 9, wherein the reinforcing material comprises a mesh material which is less extensible than the material of the outer layer, at least in the longitudinal direction thereof.

12. A whip according to claim 9, wherein the reinforcing material is generally tubular in configuration, extending coaxially with the outer layer for at least part of the length thereof.

13. A whip according to claim 9, wherein the reinforcing material is in the form at least one elongate strip extending generally longitudinally of the outer layer.

14. A whip according to claim 9, wherein the shock-absorbing means comprise a fluid enclosed between the sleeve and spine.

15. A whip according to claim 14, wherein the fluid comprises air.

16. A whip according to claim 15, wherein the outer sleeve is sealed in substantially air-tight manner around the inner spine.

17. A whip comprising an elongate self-supporting resiliently flexible inner spine, an outer flexible sleeve surrounding the inner spine and spaced therefrom and shock-absorbing means disposed between the inner spine and the surrounding sleeve along at least part of the length thereof, the outer flexible sleeve including an outer layer formed from a flexible material to which is bonded a reinforcing material which inhibits stretching of the outer layer at least in the longitudinal direction thereof, the shock-absorbing means comprising a plurality of ribs formed on the inner surface of the outer flexible sleeve and extending generally helically along at least a part of the outer sleeve.

18. A whip according to claim 17, wherein the reinforcing material comprises a mesh material which is less extensible than the material of the outer layer, at least in the longitudinal direction thereof.

19. A whip according to claim 17, wherein the reinforcing material is generally tubular in configuration, extending coaxially with the outer layer for at least part of the length thereof.

20. A whip according to claim 17, wherein the reinforcing material is in the form at least one elongate strip extending generally longitudinally of the outer layer.

21. A whip according to claim 17, wherein the shock-absorbing means comprise a fluid enclosed between the sleeve and spine.

22. A whip according to claim 21, wherein the fluid comprises air.

23. A whip according to claim 22, wherein the outer sleeve is sealed in substantially air-tight manner around the inner spine.

* * * * *